United States Patent [19]

Randolph

[11] Patent Number: 4,690,481

[45] Date of Patent: Sep. 1, 1987

[54] COAXIAL COUPLING

[76] Inventor: Walter J. Randolph, R.D. 3, Hill Rd., Crawford County, Saegertown, Pa. 16433

[21] Appl. No.: 813,530

[22] Filed: Dec. 26, 1985

Related U.S. Application Data

[63] Continuation of Ser. No. 377,617, May 13, 1982, abandoned.

[51] Int. Cl.[4] ..... H01R 17/18

[52] U.S. Cl. ..... 439/585; 439/741; 439/877

[58] Field of Search ..... 339/177, 143 R, 276 R, 339/276 T, 258 R, 278 T, 220 R, 220 M

[56] References Cited

U.S. PATENT DOCUMENTS 3,081,528 3/1963 Hanna ..... 339/258 R 3,923,367 12/1975 Carter ..... 339/177 R 4,253,234 3/1981 Niles et al. ..... 339/276 T 4,269,469 5/1981 Audic ..... 339/177 R

*Primary Examiner*—Eugene F. Desmond

*Assistant Examiner*—David Pirlot

*Attorney, Agent, or Firm*—Stoll, Wilkie, Previto & Hoffman

[57] ABSTRACT

A coaxial connector is described which has an improved plug pin and shell construction wherein the conventional machined pins and shells are replaced with stamped and drawn members providing for simpler manufacture, improved electrical and spring retention characteristics, and improved and simplified wire connections. In particular, the plug pin is hollow and is fixedly mounted in the plug shell, and the conductor is attached to the pin by a front end crimping of the hollow pin after the conductor is slipped into the pin.

1 Claim, 7 Drawing Figures

COAXIAL COUPLING

This is a continuation of application Ser. No. 377617 filed May 13, 1982 now abandoned.

BACKGROUND OF THE INVENTION

The present invention relates to electrical couplings and more particularly to improvements in bayonet coupled coaxial plugs and sockets. Coaxial couplings have been in use for many years which comprise a male connector or plug and the cooperating female connector or socket. This invention more particularly relates to an improved connector plug and to a new and improved method of manufacturing the plug pin and shell wherein these elements are formed from sheet brass by stamping and drawing operations and wherein significant advantages result from this method of manufacture and the elements thus formed.

It has been common practice in the manufacture of bayonet coupled connectors to form certain parts such as pins and shells on automatic screw machines. This is a relatively slow process and one which wastes considerable material. In particular, the connecting pin portions of the plugs as well as the surrounding shells were manufactured in this manner. The prior construction also invariably had the plug center pins formed independently of the remaining portions of the connector so that the pins are first soldered or crimped to the conductors and are thereafter inserted into the completed plug. This pin coupling method is relatively slow and difficult and occasionally results in subsequent connector failure through pin detachment.

Accordingly, an object of the present invention is to provide an improved coaxial coupling and method of manufacture.

Another object of the present invention is to provide a coaxial coupling with improved pin on contact and sleeve portions formed by stamping and drawing operations.

Another object of the present invention is to provide an improved coaxial coupling with a simplified method and means for attaching wires to the couplings.

Another object of the present invention is to provide a more easily manufactured as well as a more efficient and long lived coaxial coupling.

Other and further objects of the invention will become apparent upon an understanding of the illustrative embodiments about to be described, or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein.

DESCRIPTION OF A PREFERRED EMBODIMENT

Figures 1, 2, 3:
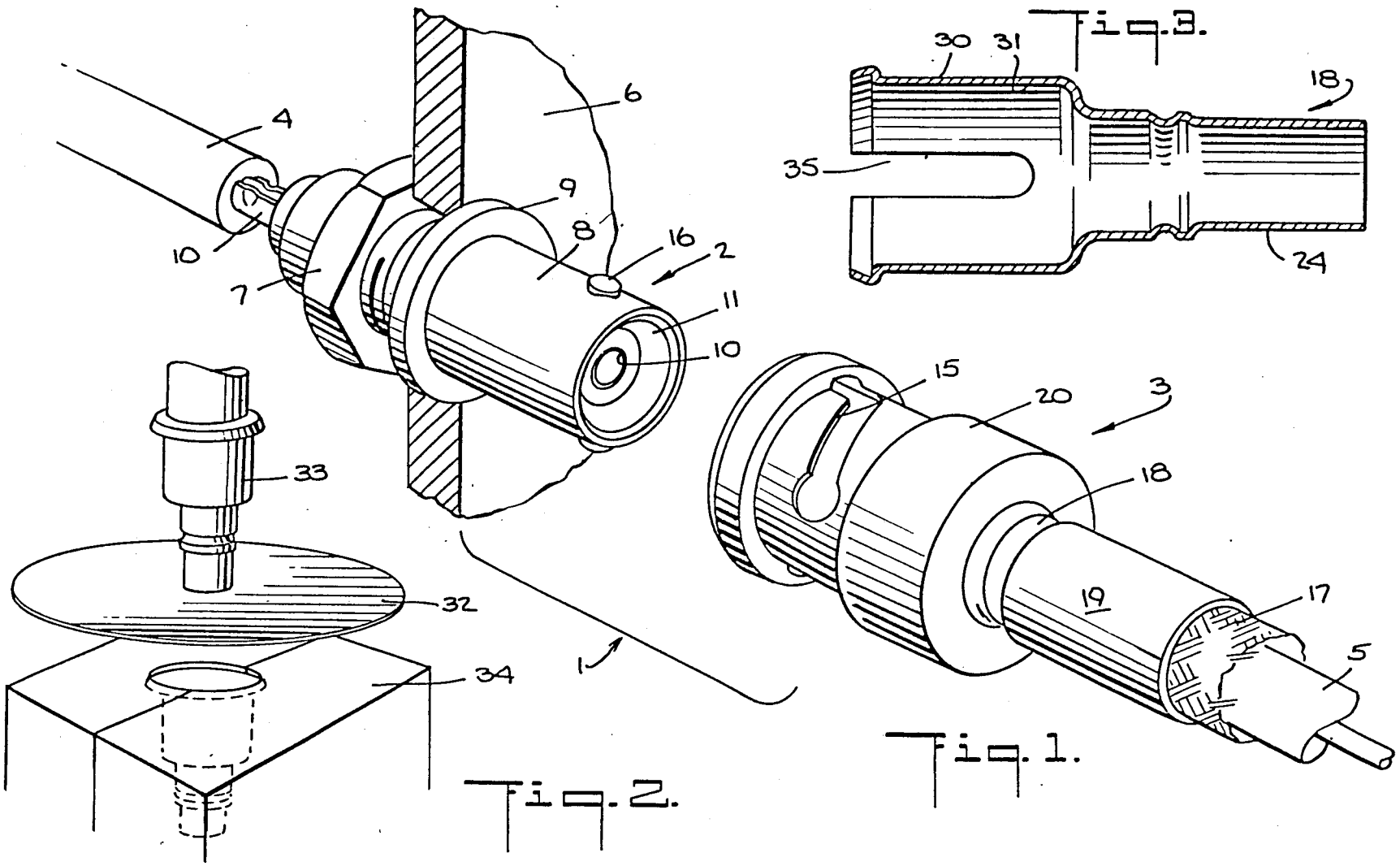
FIG. 1 is a perspective view of a coaxial coupling in accordance with the present invention.
FIG. 2 is a perspective view of a drawing operation in accordance with the present invention.
FIG. 3 is a vertical sectional view of an improved plug sleeve in accordance with the present invention.

A coupling 1 in accordance with the invention and comprising a socket 2 and a plug 3 is illustrated in FIG. 1. The coupling 1 provides a detachable connection between the two sections 4 and 5 of a coaxial cable. A mounting wall or panel is illustrated at 6 mounting the socket 2 with a nut 7 attaching the housing 8 of the socket to the wall 6 utilizing a radially extending mounting flange 9 on the housing 8. The cable 4 is attached to one end of the socket 2 on a projecting contact 10. The opposite end of the contact 10, which is mounted within an interior insulator 11, receives a pin 12 (FIG. 4) in the connector plug 3. The connector plug 3 includes an outer coupling member 20 including a locking slot 15 for engaging a locking pin 16 on the socket housing 8. The coaxial cable 5 shield 17 is attached to a projecting portion of the plug shell 18 which is surrounded by a ferrule 19.

The coupling 1 will now be described in greater detail with particular reference to FIGS. 4 and 5 which show the coupling 1 in its disconnected and connected positions respectively.

Figure 4:
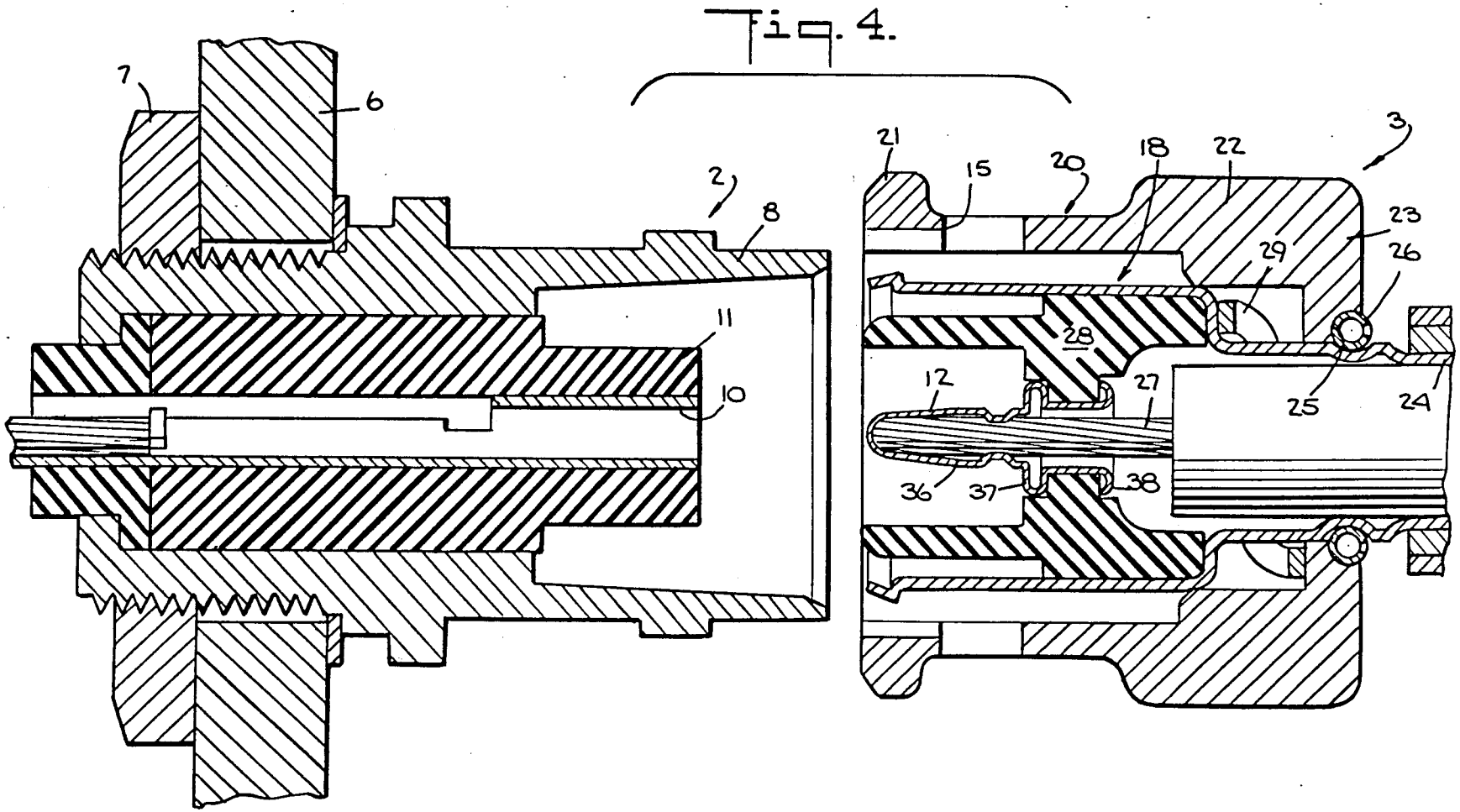
FIGS. 4 and 5 are vertical sectional views of the coupling in its uncoupled and coupled positions respectively.

Improvements in the coupling 1 of this invention are embodied in the plug pin 12 and the surrounding plug shell 18 (FIGS. 3 and 4). As illustrated in these figures, the preferred embodiment of the plug 3 comprises a shaped metal outer coupling member 20. The coupling member 20 includes a coupling flange 21 at one end and a knurled gripping flange 22 at its opposite end. The coupling slot 15 for receiving the cooperating connecting pin 16 on the socket 2 is positioned between the flanges 21 and 22. A radially inwardly projecting portion of the flange 22 has an aperture 23 for receiving the cable engaging end 24 of the shell 18. The flange 22 also includes a circular groove 25 for containing a coupling spring 26 which locks the shell 18 in position within the coupling member 20. The connecting pin 12 in the plug 3, for coupling the center conductor 27 of the coaxial cable 5 to the contact 10 in the socket 2 is fixedly mounted in an insulator member 28 molded from a suitable plastic such as polyethylene. The insulator 28 is pressed into interlocking engagement with the shell 18 and the pin 12 is locked onto the insulator 28. A spring washer 29 is positioned between the enlarged socket coupling portion 30 of the shell 18 and the flange 23 on the coupling member 20 to lock the shell assembly 18 in position within the coupling member 20.

As illustrated in FIG. 4, the shell 18 has a forward generally cylindrical flexible coupling portion 30 for engaging the housing portion 8 of the socket 2. The portion 30 includes a center cylindrical portion 31 (FIG. 3) for receiving the insulator 28 and has the lesser diameter portion 24 which projects rearwardly beyond the coupling member 20 for connection with the coaxial cable shield 17. The shell 18 is formed of metal and preferably of sheet brass. The formation is done by a blanking and drawing operations, one step of which is illustrated generally in FIG. 2, which shows a brass sheet 32 being drawn between die members 33 and 34. One or more stamping and shaping steps are required in the known manner to complete the hollow shell 18 in the shape illustrated in FIG. 3. A number of longitudinal slots 35 are provided in the shell 18 to facilitate its spring engagement with the socket 2. This method of manufacturing the shell 18 provides a shell with excellent spring retention as the drawing operations work harden the brass material which has been blanked out to form the shell. This results in a shell portion 18 for the plug 3 giving excellent electrical contact with minimal resistance and also having long spring life permitting it to remain tightly coupled and to be coupled and uncoupled an indefinite number of times.

The pin portion 12 of the plug 3 is similarly formed in a blanking and drawing operation to provide the hollow form as illustrated in FIG. 4. The pin 12 includes the projecting coupling portion 36 and a mounting flange 37 which engages the insulator 28 when the outer pin end 38 is rolled or crimped into the engagement with the insulator 28 at an insulator rear wall disposed intermediate ends of the insulator. A pin formed in this manner has the same advantages as referred to in connection with the sleeve member 18. The pin 12 is easily manufactured and has excellent electrical properties as well as mechanical spring properties. Attachment of the plug 12 to the coaxial cable is simplified since the simple crimping operation only is used to attach the wire. This provides an improvement over present coaxial connectors where the pins are separately soldered or crimped to the coaxial wires before they are inserted into the plugs and retention of the pins within the plugs depends upon the connections with the cables. Should an optional soldering step be used, a small hole may be provided in the pin 12 end.

Figure 5:
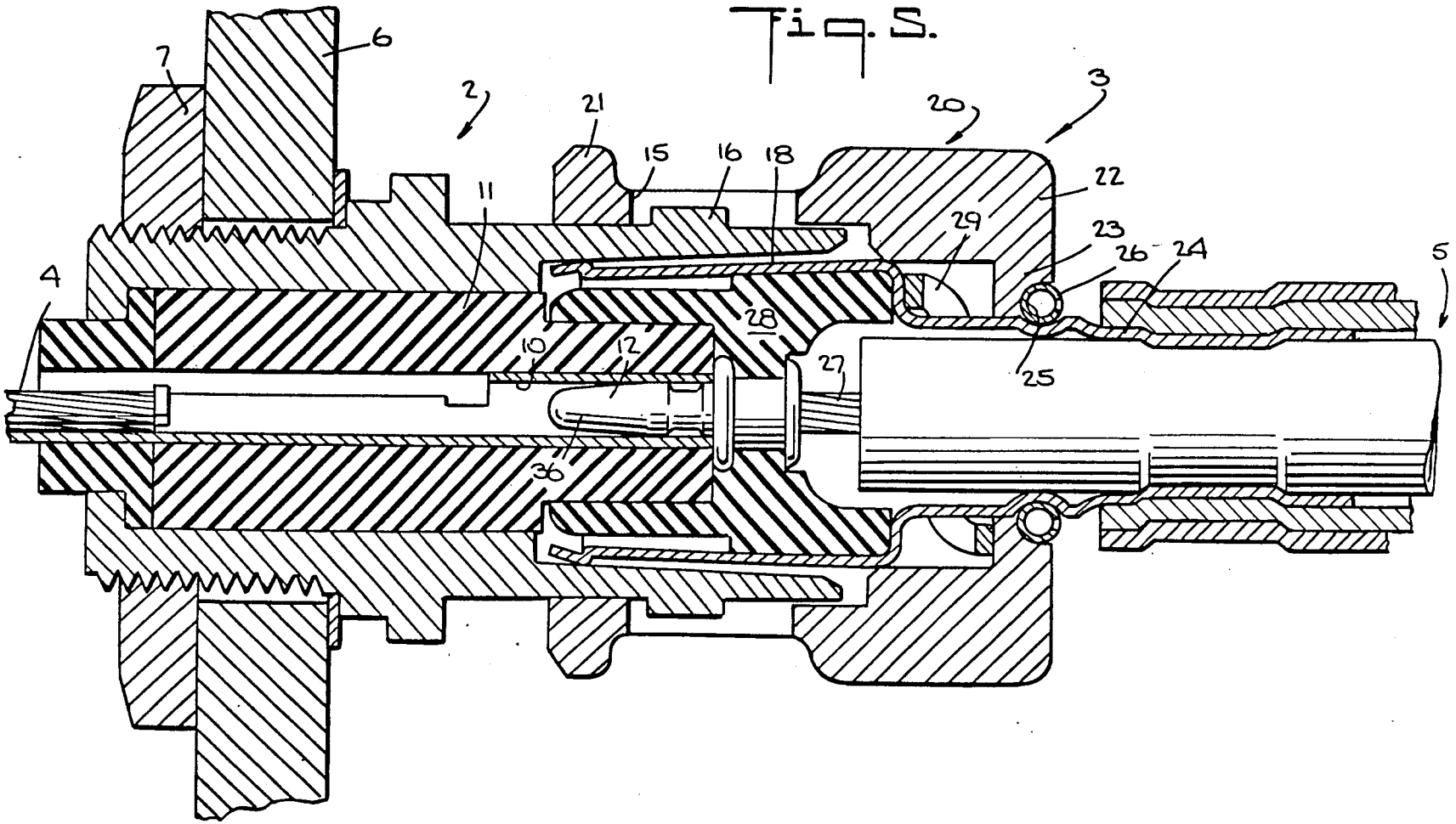

FIGS. 4 and 5 illustrate the coupling 1 in its disconnected and connected positions respectively and show the pin 12 and sleeve 18 portions of the plug 3 being moved from the disconnected position of FIG. 4 to the tightly coupled and electrically conducting position illustrated in FIG. 5. In FIG. 5, the resilient shell 18 is in tight frictional and conducting engagement with the socket housing 8 and the pin 12 is in frictional and conducting engagement with the contact 10 of the socket 2. The contact 10 is also preferably formed by blanking and drawing operations from brass material which gives it the same advantages discussed above for the pin 12 and shell portion 18 of the plug 3.

Figure 6:
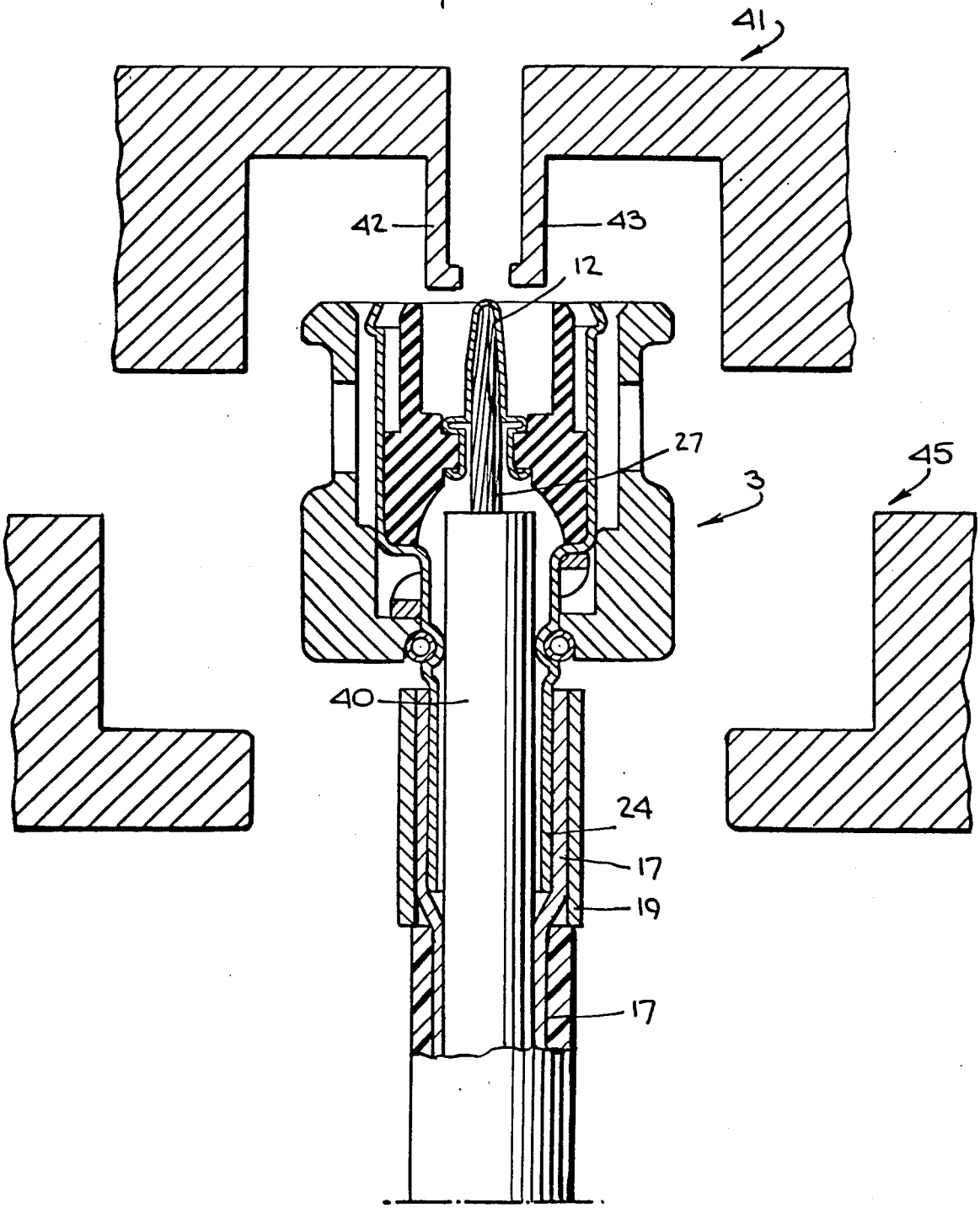
FIGS. 6 and 7 are vertical sectional views illustrating the crimping operation.
Figure 7:
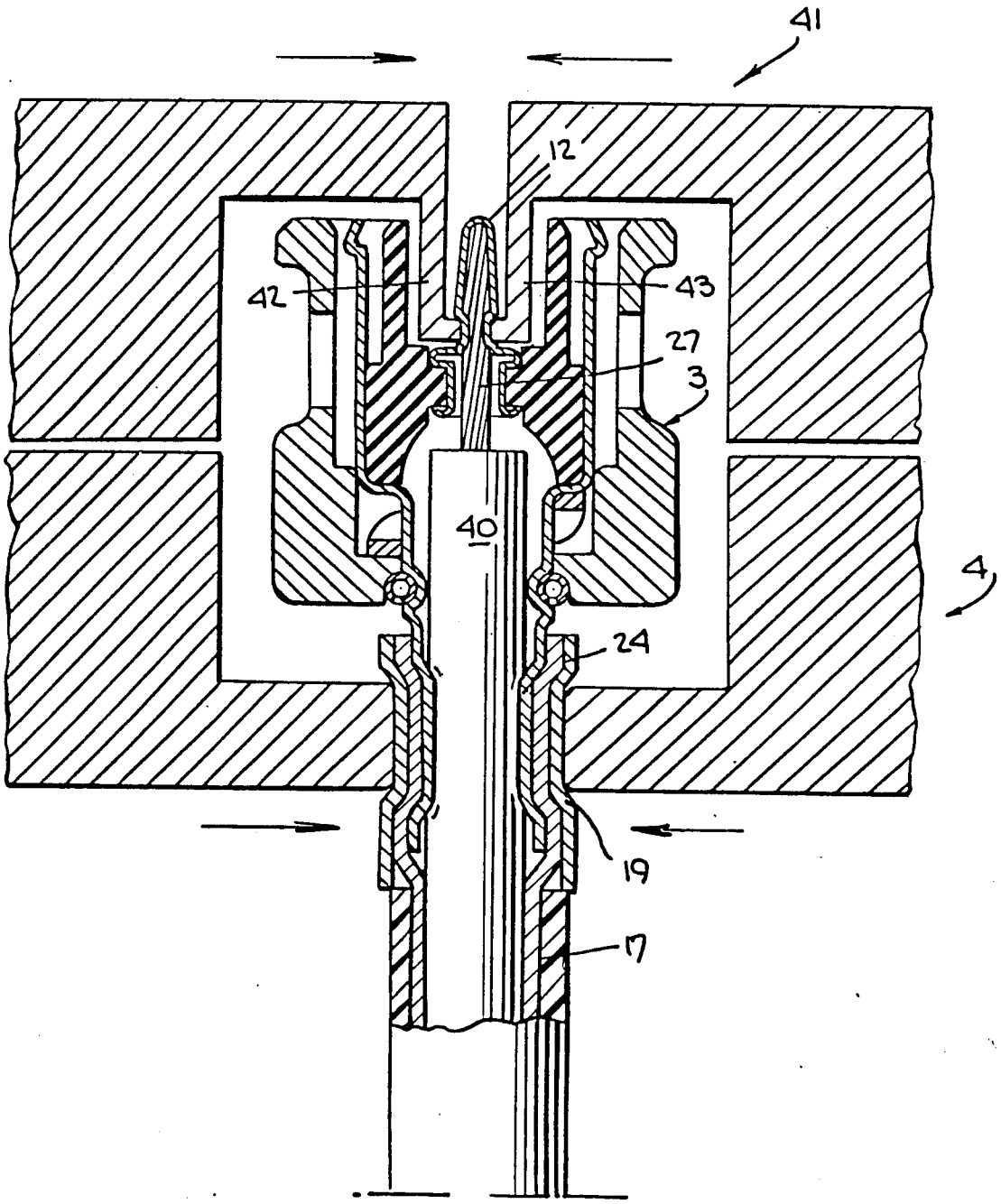

FIGS. 6 and 7 illustrate the crimping means and method by which the coaxial cable wire 27 is attached to the fully assembled plug 3 of the invention. In order to attach the wire 27, it is first inserted into the hollow pin 12 after the cable insulator 40 has been suitably cut to occupy the position illustrated and after the coaxial sheath 17 has also been cut for attachment to the end 24 of the shell 18. One form of crimping tool 41 is shown in FIGS. 6 and 7 which includes crimping portions 42 and 43. The portions 42 and 43 are shaped to fit within the plug 3 and around the hollow pin 12. Relative motion between the opposite sides of the tool 41 provides a radially inwardly directed force between crimping portions 42 and 43, which forces the pin 12 into tight locking engagement with the wire 27.

The crimping of the coaxial cable shield 17 to the shell neck 24 is accomplished by inserting the neck 24 under the shield and covering the shield 17 with a tubular ferrule 19 made of brass. A crimping tool 45 is applied which crimps the ferrule 19 through the shield 17 and engages the shell neck 24 providing a strong individual attachment and low resistance electrical attachment. It can be seen that with a proper crimp tool, both the pin and shield crimps can be made simultaneously.

It will be seen an improved coupling has been provided for use with coaxial connectors. In particular, an improved plug has been provided with improved and more easily manufactured shell and pin members. These members are not only more easily formed, but also facilitate a crimping assembly of the plug and the coupled cable and also provide improved electrical contact and increased mechanical life through improved spring retention characteristics.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described my invention, I claim:

1. In an improved plug for a coaxial connector wherein an electrical connection is made between a pin in the plug and a contact in a connector socket the improvement comprising:

a hollow forwardly opening plug shell;

a hollow forwardly opening insulator disposed and gripped within said plug shell;

a pin within the hollow of said insulator and having a hollow interior and being firmly attached to said insulator at a rear wall of said insulator hollow opening which is intermediately disposed longitudinally between ends of said insulator, said pin hollow interior opening rearwardly from said insulator rear wall for receiving a conductor and said pin hollow interior extending to the forward end of said pin within the hollow insulator;

a crimped portion on said pin forwardly of the attachment of said pin to the rear wall of said insulator and being disposed in the forwardly opening portion of said insulator;

whereby the crimped portion electrically and mechanically attaches a conductor to said pin.

* * * * *